US005739486A

United States Patent [19]

Buckingham

[11] Patent Number: 5,739,486

[45] Date of Patent: Apr. 14, 1998

[54] PUSH-BUTTON SYSTEM FOR CONTROL PANELS

[75] Inventor: Thomas John Buckingham, Allen Park, Mich.

[73] Assignee: Ford Motor Company, Dearborn, Mich.

[21] Appl. No.: 689,165

[22] Filed: Aug. 7, 1996

[51] Int. Cl.[6] ..... H01H 7/26; H01H 9/00

[52] U.S. Cl. ..... 200/5 A; 200/310; 200/315

[58] Field of Search ..... 200/5 A, 5 R, 200/6 R, 5 E, 293, 294, 296, 310–317, 341, 345, 333, 512, 517, 561

[56] References Cited

U.S. PATENT DOCUMENTS

| | | | |
|---|---|---|---|
| 3,666,899 | 5/1972 | Kerr | 200/5 E |
| 4,032,729 | 6/1977 | Koistinen | 200/5 A |
| 4,160,886 | 7/1979 | Wright et al. | 200/5 A |
| 4,354,079 | 10/1982 | Yoshimura | 200/314 |
| 4,479,040 | 10/1984 | Denley et al. | 200/77 |
| 4,531,033 | 7/1985 | Schmid et al. | 200/314 |
| 4,536,625 | 8/1985 | Bebie | 200/5 A |
| 4,634,818 | 1/1987 | Hayes-Pankhurst et al. | 200/5 A |
| 4,638,131 | 1/1987 | Kidd et al. | 200/61.55 |
| 4,845,319 | 7/1989 | Watkins et al. | 200/5 A |
| 4,967,467 | 11/1990 | Udagawa | 29/622 |
| 5,089,690 | 2/1992 | Okamura | 235/145 R |
| 5,311,656 | 5/1994 | Eldershaw | 29/622 |
| 5,424,516 | 6/1995 | Emmons | 200/344 |
| 5,504,661 | 4/1996 | Szpak | 362/30 |
| 5,557,080 | 9/1996 | Hayakawa | 200/5 R |
| 5,570,114 | 10/1996 | Fowler | 345/173 |

FOREIGN PATENT DOCUMENTS

| | | |
|---|---|---|
| 5-167659 | 7/1993 | China . |
| 2 091 941 A | 8/1982 | United Kingdom . |

*Primary Examiner*—Vit W. Miska
*Assistant Examiner*—Michael J. Hayes
*Attorney, Agent, or Firm*—Mark Mollon

[57] ABSTRACT

A button system for the control panel of an automotive audio system is adapted to curved bezel shapes wherein push buttons are non-coplanar. Each button operates normal to the bezel surface at the button location. The button system interfaces with a flat elastomeric membrane switch pad.

9 Claims, 5 Drawing Sheets

PUSH-BUTTON SYSTEM FOR CONTROL PANELS

BACKGROUND OF THE INVENTION

The present invention relates in general to a push-button system for an electrical control panel, and more specifically, to a system of hinged buttons attached to a front bezel of an audio system head unit.

Push-button switches are used to control a wide variety of electronic equipment, such as automotive audio systems. Push-button switches typically include membrane switches comprising a circuit board with interleaved, spaced conductor traces and a flexible membrane carrying a switch pad for depressing against the conductor traces to complete an electrical circuit. The circuit board is shaped as a flat plane and includes a plurality of switch circuits. The flexible membrane is usually provided by an elastomeric mat with raised membrane sections each carrying respective contact pads for respective switches. Button caps are located over the membrane sections and are typically retained by a bezel providing a finished front surface for the device and for retaining the button caps.

The button caps must be retained in a manner which avoids loose or rattling buttons, sticking or rubbing buttons, a poor tactile feel, or extraneous noises during button travel. Poor tactile feel includes a mushy feel, multiple clicks during one push of the membrane switch or insufficient button travel. Furthermore, buttons should be easy to package within the available space and should be easy to produce and assemble.

Push buttons are typically retained on the bezel in a "straight-push" configuration wherein a button cap contains a front portion for sliding through an aperture in the bezel surface and a rear collar for preventing the button cap from falling out the front of the aperture. A flat retaining plate is usually attached to the rear side of the bezel to maintain the button caps in position. The retaining plate typically includes a smaller aperture through which a rear projecting finger from the button cap is allowed to pass in order to interface with the membrane switch. The retaining plate may be comprised of a clear material in order to also function as a light guide for passing light from a light source (e.g., an incandescent bulb) to backlit graphics on the bezel and the push buttons.

A similar button cap which simulates a rocker switch is known wherein an elongated button cap is retained in a manner to give a "teeter-totter" type motion for activating one of two separate membrane switches at a time. A pivot pin projecting across the center of an elongated button cap is retained between the bezel and the support plate.

Straight-push buttons in particular are subject to a number of problems such as button wobble wherein a button cap moves from side to side due to too much clearance between the bezel and the button cap. Alternatively, if clearance between the button and bezel is reduced to control wobble, interference may occur which causes buttons to become stuck. If buttons are not retained under a positive force at all times, then rattling may occur from vibrations such as would occur when driving a vehicle over a rough surface.

Bezels for automotive audio systems have typically been flat. This simplified the push-button system since the bezel conformed to the surface of the printed circuit board carrying the switch contacts as well as the light sources and information displays. Recently, however, curved bezels have been employed to improve the styling appearance of automotive audio systems. A curved bezel surface may result in uneven support for button caps which would typically lead to button wobble. Furthermore, tactile feel of buttons could vary at different curved portions of the bezel, which would be undesirable.

SUMMARY OF THE INVENTION

The present invention provides a push-button system wherein loose and rattling buttons as well as sticking or rubbing buttons are avoided while providing consistent tactile feel in a system that is easy to package and assemble. The system allows greater flexibility in the styling of the bezel without imposing additional requirements on the flexible switch circuitry.

In one aspect, the present invention provides an electrical control panel comprising a plurality of integrally-formed button caps. Each button cap includes a front push surface, an edge hinge pin, and a rear-projecting finger. Each bezel has an outside surface and an inside surface and includes a plurality of non-coplanar button apertures. Each button aperture receives a respective button cap. The trim bezel further includes hinge slots in the inside surface substantially tangent with respective button apertures for receiving respective edge hinge pins.

A flexible switch circuit includes a plurality of substantially coplanar membrane switches, each membrane switch being aligned with a respective rear-projecting finger of a respective button cap. A support frame is disposed between the flexible switch circuit and the trim bezel which includes a plurality of stanchions each pivotally retaining a respective edge hinge pin in a respective hinge slot. The lengths of each respective stanchion and each respective rear-projecting finger are determined according to a distance between their respective button apertures and their respective membrane switches.

DETAILED DESCRIPTION OF PREFERRED EMBODIMENTS

Figure 1:
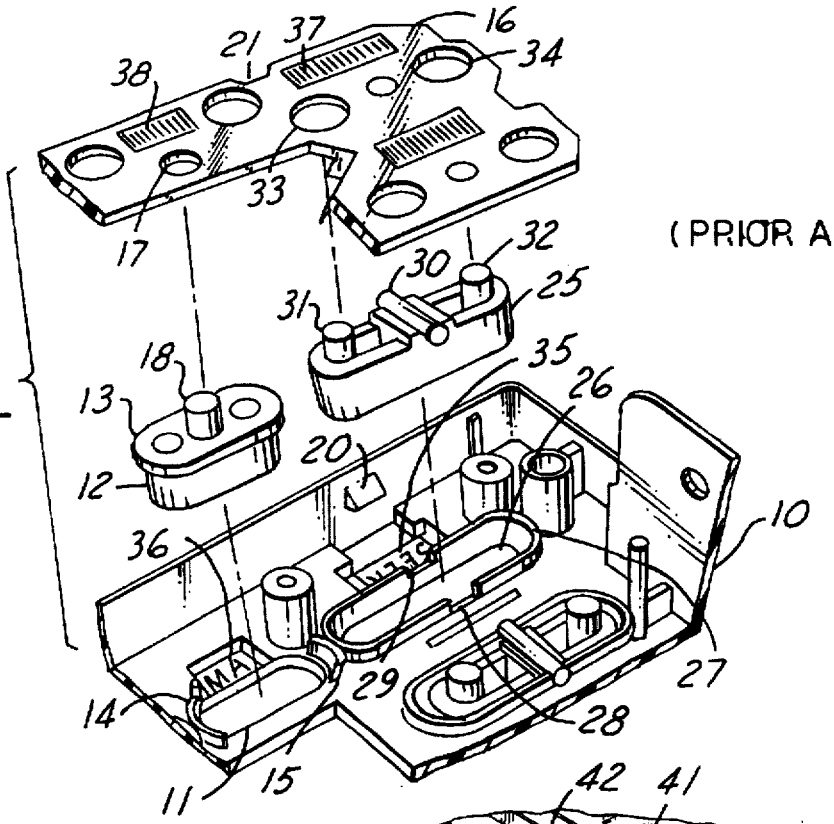
(PRIOR ART) FIG. 1
FIG. 1 is an exploded perspective view of a prior art control panel having straight-push buttons and teeter-totter push buttons.

FIG. 1 shows a prior art control panel having a front bezel 10 including an aperture 11 for receiving a push button 12 of the "straight-push" type. A lip 13 on push button 12 has a diameter larger than aperture 11 to prevent it from falling out of bezel 10. Collar sections 14 and 15 extend from the back of bezel 10 for slidably receiving lip 13 as push button 12 travels in the straight-push direction- A retainer plate 16 is affixed behind push button 12 such that an aperture 17 receives a push finger 18 extending from the rear side of push button 12. Push finger 18 extends through aperture 17 to contact a membrane switch (not shown). Retainer 16 lays against collars 14 and 15 and is snapped in place by a tab 20 extending from a side wall of bezel 10. Tab 20 snaps onto a land 21 on retainer 16.

Prior art bezel 10 also includes a teeter-totter rocker switch including a push button 25 for mounting in an aperture 26 in bezel 10. A collar 27 surrounding aperture 26 includes notches 28 and 29 for receiving a rocker pin 30 attached to the rear side of push button 25. Retainer 16 lies against collar 27 thereby capturing rocker pin 30 in notches 28 and 29.

A pair of push fingers 31 and 32 pass through a pair of apertures 33 and 34, respectively, in retainer 16.

In addition to retaining the push buttons against the bezel, retainer 16 is fabricated of a clear plastic in order to function as a light guide to distribute light from light sources, such as incandescence bulbs (not shown) to back-lit graphics on the bezel including translucent graphics 35 and 36. Stepped sections 37 and 38 in retainer 16 direct light out from the light guide toward the graphics.

Prior art audio systems have also included a hinged button which is attached to the bezel from the front. One button side pivotally snaps into a recess while the opposite side includes a projection for interfering with the back side of the bezel to create an aligned rest position under pressure from the membrane switch. In this prior art, as embodied in the Ford 2006 series radio, the bezel is flat and a flat printed circuit board directly attaches to the rear of the bezel assembly.

Figure 2:
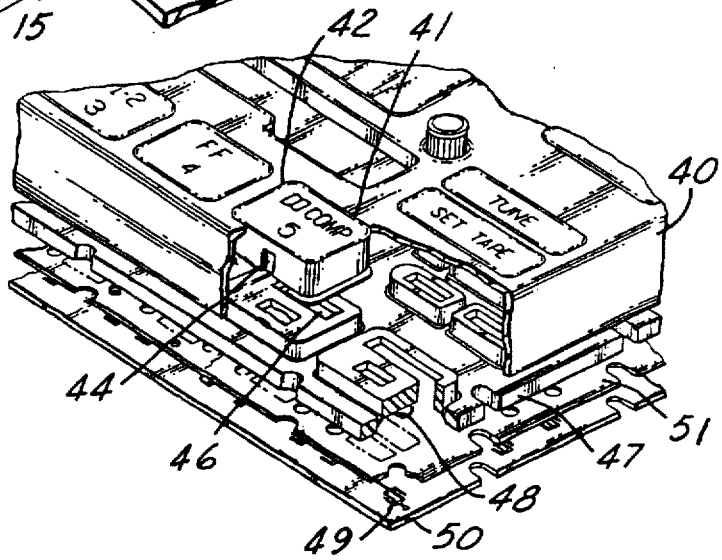
(PRIOR ART) FIG. 2
FIG. 2 is a perspective, cut-away, exploded view of another prior art control panel using straight push buttons.
Figure 3:
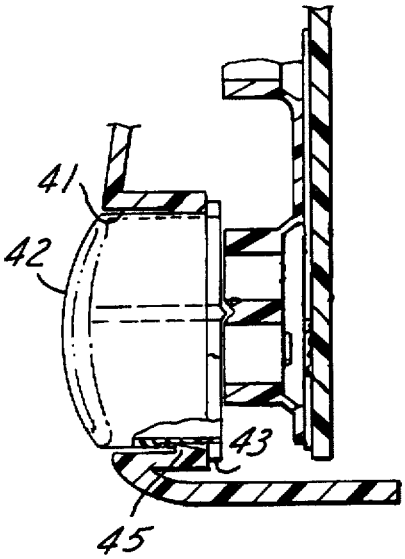
(PRIOR ART) FIG. 3
FIG. 3 is a side sectional view through a push button of FIG. 2.

Referring to FIGS. 2 and 3, yet another prior art control panel assembly utilizing a substantially flat bezel is shown. Bezel 40 includes an aperture 41 receiving a button cap 42. Button cap 42 has a lip 43 for retaining the button cap in aperture 41. Button cap 41 also includes side slots 44 on opposite sides receiving ramp protrusions 45 on the sides of apertures 41 to further retain button caps in place and to control straight-push movement. Button cap 42 controls movements of a membrane switch 46 of an elastomeric switch pad 47. Each membrane switch includes a contact member 48 for contacting terminal conductors 49 on a printed circuit board 50. An electroluminescent panel 51 is disposed between elastomeric switch pad 47 and printed circuit board 50 to supply illumination to the bezel and button graphics. Electroluminescent panel 51 includes apertures aligned with contact members 48 to allow them to directly contact conductors 49 when push buttons are depressed.

The configurations of these prior art push button assemblies were specially adapted to the use of flat bezels and flat printed circuit boards wherein all push buttons operate perpendicularly to the flat planar surfaces.

Figure 4:
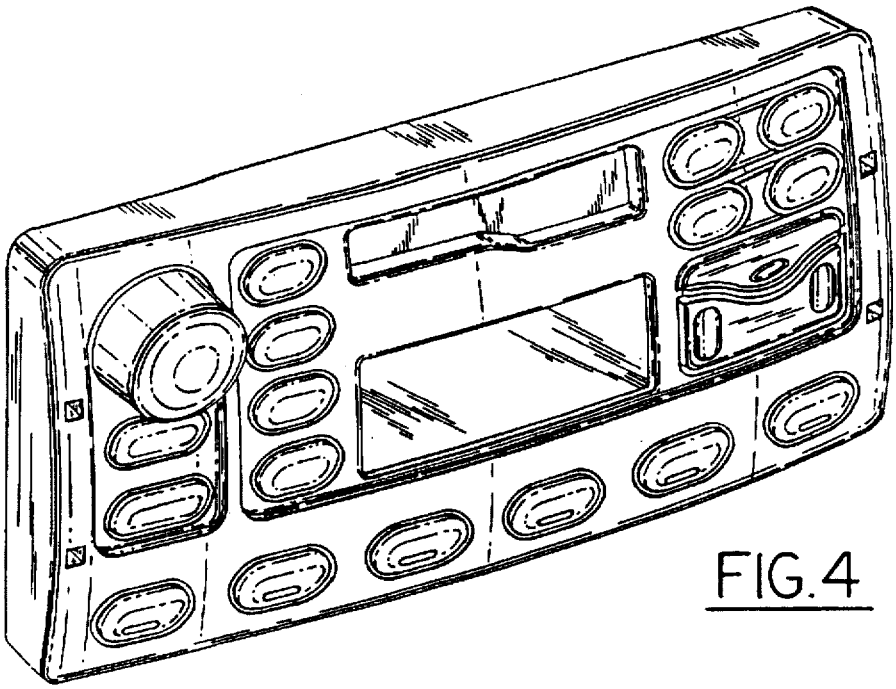
FIG. 4 is a front, top and left perspective view of a curved bezel of the type used in the present invention.
Figure 6:
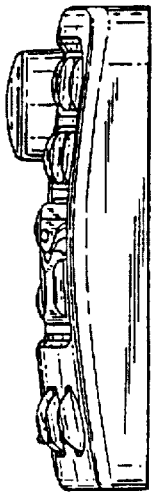
FIG. 6 is a side plan view of the bezel of FIG. 4.

FIG. 4 shows a curved bezel styling as is used in the present invention including a plurality of push buttons, an adjustment knob, a cassette aperture, and a display aperture for viewing a visual display device. As shown in FIG. 6, the bezel is curved from top to bottom as well as from side to side. Thus, the front push surfaces of various button caps are located at variable distances from the flat printed circuit board and from the membrane switches that must be activated by the button caps. Furthermore, since the bezel surface is curved, the normal axis at each button aperture is not parallel with the others.

Figure 5:
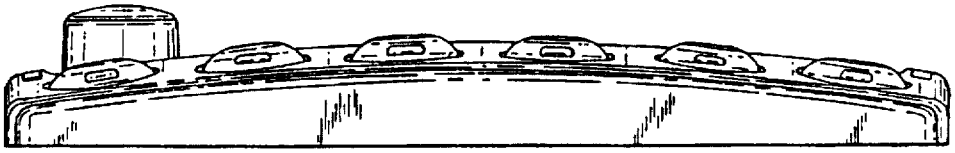
FIG. 5 is a bottom plan view of the bezel in FIG. 4.

FIG. 5 is a bottom view of the bezel showing that the variations in normal axes and in distance protruding away from the printed circuit board can be large.

Figure 7:
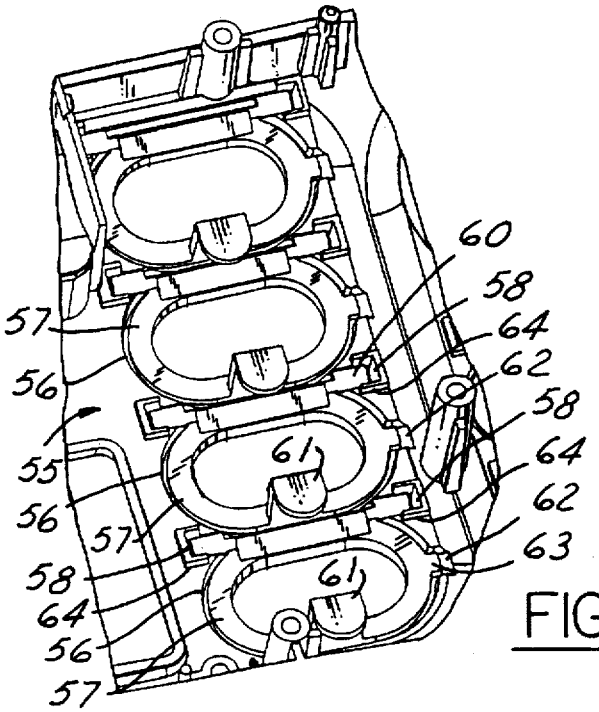
FIG. 7 is a rear perspective view showing button caps loaded into the rear side of a trim bezel.

The present invention uses top hinged, rear loaded button caps as shown in FIG. 7. A bezel 55 includes a plurality of button apertures 56 for receiving a plurality of button caps 57. Due to the curvature of bezel 55, apertures 56 are non-coplanar. Each aperture 56 has an associated hinge slot 58 substantially tangent with the respective aperture. Button caps 57 include edge hinge pins 60 which are received in respective hinge slots 58. Each button cap 57 includes a rear-projecting finger 61 for interacting with a respective membrane switch. The inside surface of bezel 55 further includes alignment slots 62 receiving alignment tabs 63 on the periphery of button caps 57.

As shown in FIG. 7, hinge slots 58 may preferably include raised end walls 64. Depending upon the thickness of the bezel available for forming a channel, such end walls may not be necessary.

Figure 8:
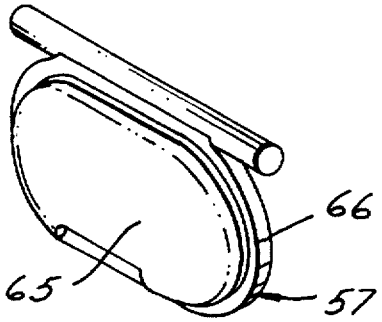
FIG. 8 is a front, right perspective view of a button cap.

FIG. 8 shows a front push surface 65 of a button cap 57. A peripheral collar 66 helps prevent button cap 57 from pivoting outward through the button aperture.

As shown in FIG. 7, each rear-projecting finger of each respective button cap 57 extends a respective length which is determined in accordance with the distance between each respective button aperture and its respective membrane switch. In other words, rear-projecting fingers have lengths which interface between the non-coplanar button apertures and the coplanar membrane switches.

Figure 9:
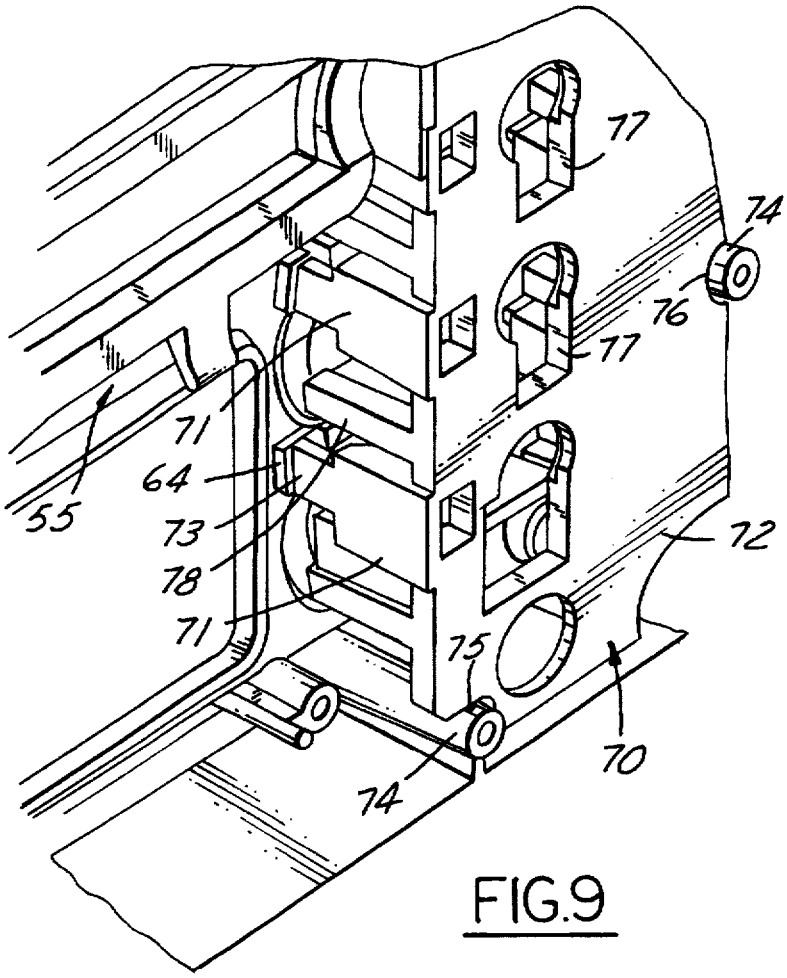
FIG. 9 is a rear perspective view showing a button frame securing button caps into their respective hinge slots.

FIG. 9 shows a button frame 70 for retaining the edge hinge pins of the buttons caps in their respective hinge slots while providing a rear planar surface for mating with the elastomeric switch pad. Thus, a plurality of stanchions 71 extend from a base plate 72 toward respective hinge slots. Each stanchion has a respective length depending upon the bezel curvature. Each stanchion 71 has a distal end 73 which contacts walls 64 to pivotally retain each respective edge hinge pin. Button frame 70 is kept in alignment by extension features 74 which are provided as part of bezel 55. Alignment surfaces 75 and apertures 76 in base plate 72 interface with alignment features 74. Button frame 70 is positively retained to bezel 55 by heat staking of an alignment feature 74 with frame 70, for example. Base plate 72 includes apertures 77 for receiving rear-projecting fingers of respective button caps in order to allow them to interact with the respective membrane switches. Apertures 77 are also shaped in a manner to allow projection of light through base plate 72 toward back-lit graphics.

Figure 10:
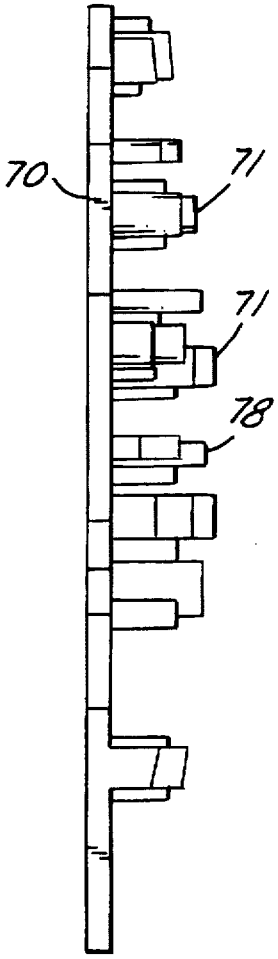
FIG. 10 is a side plan view of the frame of FIG. 10.

FIG. 10 shows a side view of button frame 70. Stanchions 71 have respective heights as determined by the curvature of the bezel. Button frame 70 may also include a plurality of posts 78 aligned with the periphery of respective button caps to limit the pivotal movement of the button caps when they are pressed.

Figure 11:
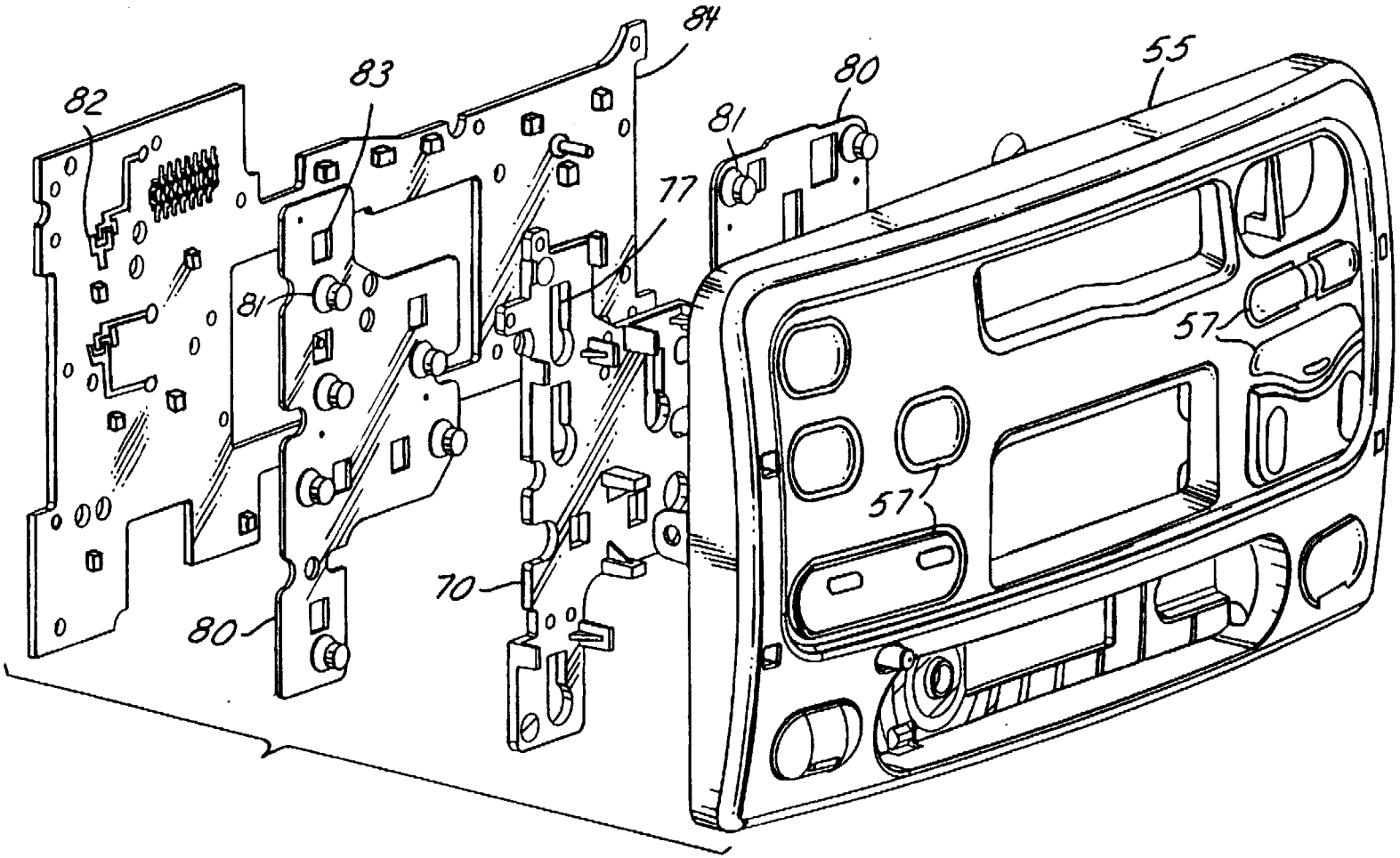
FIG. 11 is a front perspective, exploded view of a control panel according to the present invention.

FIG. 11 shows an exploded perspective view of the control panel of the present invention. The elastomeric switch pad 80 includes membrane switches 81 aligned with terminal contacts 82 on printed circuit board 84. A source of illumination (not shown), such as incandescent bulbs, LEDs, or an electroluminescent panel, is disposed on or over printed circuit board 84 according to any known method (see, e.g., FIG. 2). Apertures 83 in elastomeric switch pad 80 and apertures 77 in button frame 70 allow illumination to pass through to back-lit graphics on bezel 55 and button caps 57.

Figure 12:
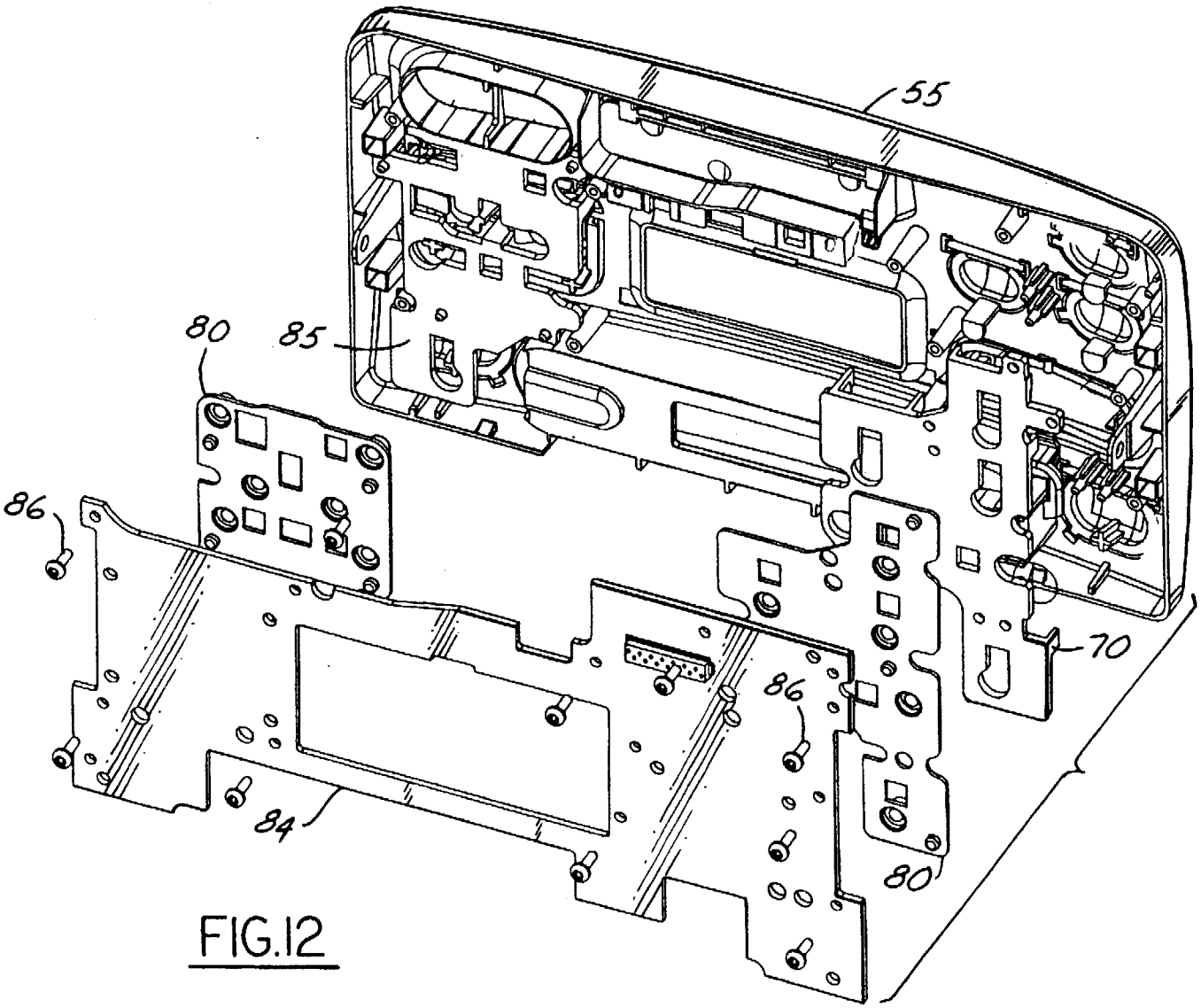
FIG. 12 is a rear exploded view of the control panel of FIG. 11.

FIG. 12 shows a rear exploded view of the control panel of the present invention. Button frame 70 is shown removed from bezel 55 while a second button frame 85 is shown mounted in place at the opposite end of bezel 55. Printed circuit board 84 is attached to bezel 55 by a plurality of screws 86.

What is claimed is:

1. An electrical control panel comprising:

a plurality of integrally-formed button caps, each button cap including a front push surface, an edge hinge pin substantially tangent with an edge of said button cap, and a rear-projecting finger;

a trim bezel having a curved outside surface and a curved inside surface and including a plurality of non-coplanar button apertures, each button aperture receiving a respective button cap, said trim bezel further including hinge slots in said inside surface substantially tangent with respective button apertures for receiving respective edge hinge pins;

a flexible switch circuit including a plurality of substantially coplanar membrane switches, each membrane switch being aligned with a respective rear-projecting finger of a respective button cap, whereby distances between each respective button aperture and its respective membrane switch are not all equal;

a support frame disposed between said flexible switch circuit and said trim bezel, said support frame including a plurality of stanchions each pivotally retaining a respective edge hinge pin in a respective hinge slot;

wherein lengths of each respective stanchion and of each respective rear-projecting finger are determined according to a distance between their respective hinge slots and their respective membrane switches.

2. The electrical control panel of claim 1 wherein said support frame is fixedly attached to said trim bezel to retain said button caps.

3. The electrical control panel of claim 1 wherein said button caps further include peripheral alignment tabs and said trim bezel further includes alignment slots adjacent said button apertures receiving said peripheral alignment tabs.

4. An automotive audio system comprising:

an audio system chassis;

a plurality of integrally-formed button caps, each button cap including a front push surface, an edge hinge pin substantially tangent with an edge of said button cap, and a rear-projecting finger;

a trim bezel having an outside surface and an inside surface and including a plurality of non-coplanar button apertures, each button aperture receiving a respective button cap, said trim bezel further including hinge slots in said inside surface substantially tangent with respective button apertures for receiving respective edge hinge pins;

a flexible switch mat including a plurality of substantially coplanar membrane switches, each membrane switch being aligned with a respective rear-projecting finger of a respective button cap;

a support frame disposed between said flexible switch mat and said trim bezel, said support frame including a plurality of stanchions each pivotally retaining a respective edge hinge pin in a respective hinge slot;

wherein lengths of each respective stanchion and of each respective rear-projecting finger are determined according to a distance between their respective hinge slots and their respective membrane switches.

5. The automotive audio system of claim 4 wherein said trim bezel further includes a display aperture for a visual display device, said display aperture being unobstructed by said support frame.

6. The automotive audio system of claim 4 wherein said trim bezel has a curved inside surface, whereby distances between each respective button aperture and its respective membrane switch are not all equal.

7. The automotive audio system of claim 4 wherein said support frame is fixedly attached to said trim bezel to retain said button caps.

8. The automotive audio system of claim 4 wherein said button caps further include peripheral alignment tabs and said trim bezel further includes alignment slots adjacent said button apertures receiving said peripheral alignment tabs.

9. The automotive audio system of claim 4 wherein said button caps include translucent graphics.

* * * * *